US007783243B2

(12) United States Patent
Cahill et al.

(10) Patent No.: US 7,783,243 B2
(45) Date of Patent: Aug. 24, 2010

(54) ENHANCED FUSER OFFSET LATITUDE METHOD

(75) Inventors: David F. Cahill, Rochester, NY (US); Mark C. Zaretsky, Rochester, NY (US); William J. Hagen, Hilton, NY (US)

(73) Assignee: Eastman Kodak Company, Rochester, NY (US)

( * ) Notice: Subject to any disclaimer, the term of this patent is extended or adjusted under 35 U.S.C. 154(b) by 151 days.

(21) Appl. No.: 11/958,831

(22) Filed: Dec. 18, 2007

(65) Prior Publication Data

US 2009/0154948 A1 Jun. 18, 2009

(51) Int. Cl.
*G03G 15/20* (2006.01)

(52) U.S. Cl. ..... 399/341; 399/69

(58) Field of Classification Search ..... 399/69, 399/324, 341, 342

See application file for complete search history.

(56) References Cited

U.S. PATENT DOCUMENTS 5,887,234 A 3/1999 Aslam et al.
6,369,136 B2 4/2002 Sorriero et al.
6,909,871 B2 6/2005 Behnke et al.
7,024,149 B2 * 4/2006 Kito et al. ..... 399/341
7,139,521 B2 11/2006 Ng et al.
7,236,734 B2 6/2007 Ng et al.
7,421,231 B2 9/2008 Bessho
2006/0188295 A1 * 8/2006 Kasiske et al. ..... 399/182
2006/0285890 A1 12/2006 Ng

* cited by examiner

*Primary Examiner*—Sandra L Brase
(74) *Attorney, Agent, or Firm*—Donna P. Suchy

(57) ABSTRACT

Electrophotographic printing of one or more layers of toner using a method of enhancing fuser offset latitude to enable the printing of a wide range of toner mass laydown using electrophotography. This method encompasses the steps of forming multicolor toner images, determining the amount of clear overcoat mass laydown as a function of the color mass laydown or non-raised mass laydown and fusing the clear toner overcoat and the multicolor toner image at a fusing temperature determined by the maximum total mass laydown and the nip width to provide good adhesion to the receiver member while optimizing fuser offset latitude.

22 Claims, 7 Drawing Sheets

ENHANCED FUSER OFFSET LATITUDE METHOD

FIELD OF THE INVENTION

This invention relates in general to electrographic printing, and more particularly to a method of enhancing fuser offset latitude to enable the printing of a wide range of toner mass laydown and the printing onto a wide range of receiver members using electrophotography.

BACKGROUND OF THE INVENTION

One common method for printing images on a receiver member is referred to as electrography. In a particular implementation of this method, known as electrophotography, an electrostatic image is formed on a dielectric member by uniformly charging the dielectric member and then discharging selected areas of the uniform charge to yield an image-wise electrostatic charge pattern. Such discharge is typically accomplished by exposing the uniformly charged dielectric member to actinic radiation provided by selectively activating particular light sources in an LED array or a laser device directed at the dielectric member. After the image-wise charge pattern is formed, the pigmented (or in some instances, non-pigmented) marking particles are given a charge, substantially opposite the charge pattern on the dielectric member and brought into the vicinity of the dielectric member so as to be attracted to the image-wise charge pattern to develop such pattern into a visible image.

Thereafter, a suitable receiver member, sometimes simply referred to as a receiver, (e.g., a cut sheet of plain bond paper) or an intermediate receiver member, sometimes simply referred to as an intermediate, (e.g. a compliant or non-compliant roller or web) is brought into juxtaposition with the marking particle developed image-wise charge pattern on the dielectric member. A suitable electric field is applied to transfer the marking particles to the receiver member in the image-wise pattern to form the desired print image on the receiver or intermediate receiver member. In the case of an intermediate receiver member, a secondary transfer step is performed whereby a second suitable electric field is applied to transfer the marking particles from the intermediate receiver member to the receiver member. The receiver member is then removed from its operative association with the dielectric member and the marking particle print image is permanently fixed to the receiver member typically using heat, pressure or and pressure. Multiple layers or marking materials can be overlaid on one receiver, for example layers of different color particles can be overlaid on one receiver member to form a multi-color print image on the receiver member after fixing.

The use of toner particles, also referred to as marking particles, in electrophotographic printing, to create a raised surface or other specialized image, in some cases, has led to poor quality prints, machine contamination issues, and color shifts. For instance, the addition of a clear toner in these regions to provide a raised print having tactile feel increases the total mass per unit area of toner that needs to be fixed to the receiver member to levels greater than in the past. For a roller fusing system this necessitates high fuser roller surface temperatures and long fuser nip dwell times to achieve good toner adhesion for the high toner mass laydown regions, especially when the receiver member is a heavyweight (such as a weight of greater than 180 gsm) uncoated paper. Unfortunately, this results in substantial hot offset artifacts in the lower toner mass laydown regions, e.g. non-raised areas, creating ghost images in multiple sheet printing jobs and thus reducing the fuser offset latitude. The fuser offset latitude is the range of temperatures between the lowest temperature where the toner will stick to the receiver at maximum laydown and the highest temperature where the toner sticks to the receiver and does not stick to the fuser roller at low and intermediate laydowns. The hot offset also greatly increases the contamination of other rollers associated with the fusing subsystem such as the donor and metering rollers used to apply a release agent such as silicone oil to the surface of the fuser roller, greatly increasing the maintenance requirement of these rollers so as to prevent image artifacts. Furthermore, during the fusing process the high laydown of clear toner inhibits the flowing and coalescing of the toner layers underneath, allowing the receiver member to appear through the gaps in the discrete toner particles. This reduces the level of color saturation, creating an unwanted shift in color when comparing the same image area, raised versus non-raised.

A related problem may be encountered when trying to fuse layers of toner onto a dense or coated receiver member, particularly members that do not readily absorb the oil often used as a release agent in roller fusing systems. Often the fuser temperature and nipwidth must be greatly increased so as to provide adequate adhesion of the toner layers onto this type of receiver. These extreme fusing conditions may result in hot offset of the toner onto the fuser roller, again causing the problems described above, often resulting in very little or no fuser hot offset latitude.

In order to improve image quality and reduce maintenance of the fuser subsystem, as well as increase the range of fusable receiver members, a method for increasing the fuser offset latitude is needed.

SUMMARY OF THE INVENTION

This invention is directed to a method of enhancing fuser-offset latitude to enable the printing of a wide range of toner mass laydown using electrophotography. This method encompasses the steps of forming multicolor toner images, determining the amount of clear overcoat mass laydown (OML) as a function of the color mass laydown (CML) or non-raised mass laydown (NRML) of one or more layers of color toner, and fusing the clear toner overcoat and the multicolor toner image at a fusing temperature determined by the maximum total mass laydown (TML) and the nip width to provide good adhesion to the receiver member while optimizing fuser offset latitude.

BRIEF DESCRIPTION OF THE DRAWINGS

In the detailed description of the preferred embodiment of the invention presented below, reference is made to the accompanying drawings.

DETAILED DESCRIPTION OF THE INVENTION

Figure 1:
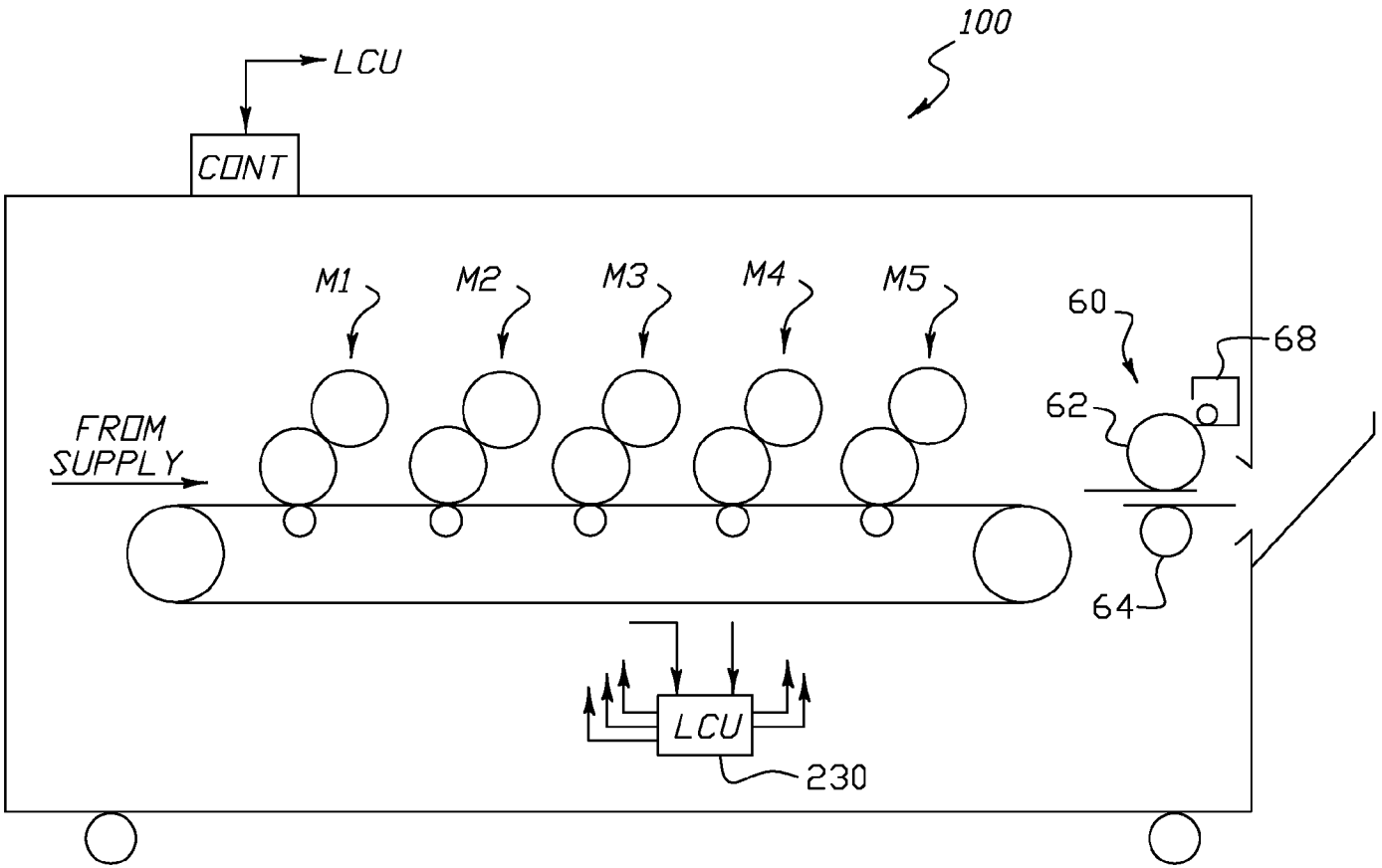
FIG. 1 is a schematic side elevational view, in cross section, of a typical electrophotographic reproduction apparatus suitable for use with this invention.
Figure 2:
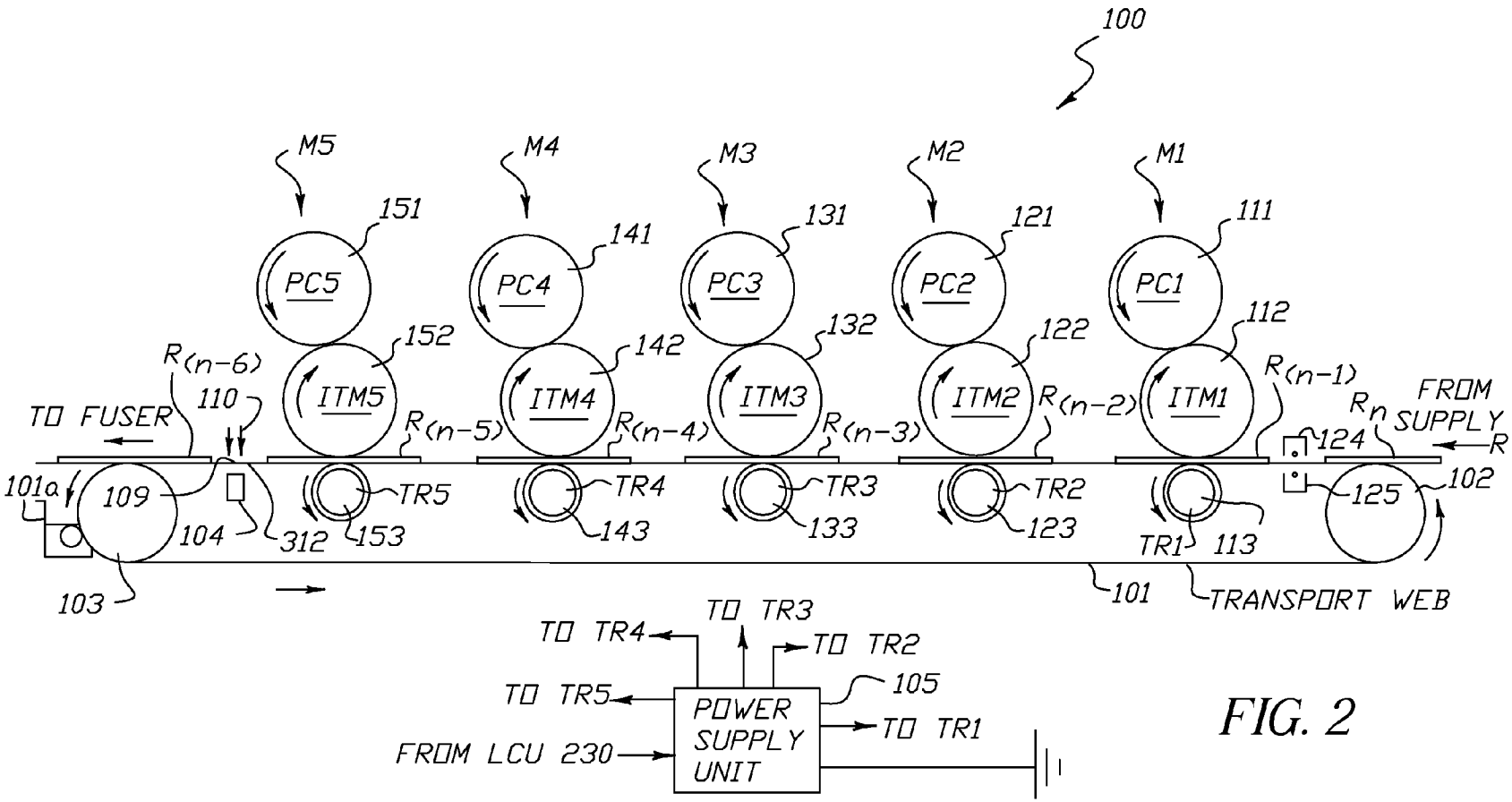
FIG. 2 is a schematic side elevational view, in cross section, of the reprographic image-producing portion of the electrophotographic reproduction apparatus of FIG. 1, on an enlarged scale.

Referring now to the accompanying drawings, FIGS. 1 and 2 are side elevational views schematically showing portions of a typical electrophotographic print engine or printer apparatus suitable for printing of pentachrome images. Although one embodiment of the invention involves optimized printing using an electrophotographic engine having five sets of single color image producing or printing stations or modules arranged in tandem, the invention contemplates that more or less than five stations may be combined to deposit toner on a single receiver member, or may include other typical electrographic writers or printer apparatus.

An electrophotographic printer apparatus 100 has a number of tandemly arranged electrostatographic image forming printing modules M1, M2, M3, M4, and M5. Additional modules may be provided. Each of the printing modules generates a single-color toner image for transfer to a receiver member successively moved through the modules. Each receiver member, during a single pass through the five modules, can have transferred in registration thereto up to five single-color toner images to form a pentachrome image. As used herein, the term pentachrome implies that in an image formed on a receiver member combinations of subsets of the five colors are combined to form other colors on the receiver member at various locations on the receiver member, and that all five colors participate to form process colors in at least some of the subsets wherein each of the five colors may be combined with one or more of the other colors at a particular location on the receiver member to form a color different than the specific color toners combined at that location.

In a particular embodiment, printing module M1 forms black (K) toner color separation images, M2 forms yellow (Y) toner color separation images, M3 forms magenta (M) toner color separation images, and M4 forms cyan (C) toner color separation images. Printing module M5 may form a red, blue, green or other fifth color separation image. It is well known that the four primary colors cyan, magenta, yellow, and black may be combined in various combinations of subsets thereof to form a representative spectrum of colors and having a respective gamut or range dependent upon the materials used and process used for forming the colors. However, in the electrophotographic printer apparatus, a fifth color can be added to improve the color gamut. In addition to adding to the color gamut, the fifth color may also be used as a specialty color toner image, such as for making proprietary logos, or a clear toner for image protective purposes.

Receiver members ($R_n$-$R_{(n-6)}$ as shown in FIG. 2) are delivered from a paper supply unit (not shown) and transported through the printing modules M1-M5 in a direction indicated in FIG. 2 as R. The receiver members are adhered (e.g., preferably electrostatically via coupled corona tack-down chargers 124, 125) to an endless transport web 101 entrained and driven about rollers 102, 103. Each of the printing modules M1-M5 similarly includes a photoconductive imaging roller, an intermediate transfer member roller, and a transfer backup roller. Thus in printing module M1, a black color toner separation image can be created on the photoconductive imaging roller PC1 (111), transferred to intermediate transfer member roller ITM1 (112), and transferred again to a receiver member moving through a transfer station, which transfer station includes ITM1 forming a pressure nip with a transfer backup roller TR1 (113). Similarly, printing modules M2, M3, M4, and M5 include, respectively: PC2, ITM2, TR2 (121, 122, 123); PC3, ITM3, TR3 (131, 132, 133); PC4, ITM4, TR4 (141, 142, 143); and PC5, ITM5, TR5 (151, 152, 153). A receiver member, $R_n$, arriving from the supply, is shown passing over roller 102 for subsequent entry into the transfer station of the first printing module, M1, in which the preceding receiver member $R_{(n-1)}$ is shown. Similarly, receiver members $R_{(n-2)}$, $R_{(n-3)}$, $R_{(n-4)}$, and $R_{(n-5)}$ are shown moving respectively through the transfer stations of printing modules M2, M3, M4, and M5. An unfused image formed on receiver member $R_{(n-6)}$ is moving as shown towards a fuser of any well known construction, such as the fuser assembly 60 (shown in FIG. 1).

A power supply unit 105 provides individual transfer currents to the transfer backup rollers TR1, TR2, TR3, TR4, and TR5 respectively. A logic and control unit 230 (FIG. 1) includes one or more computers and in response to signals from various sensors associated with the electrophotographic printer apparatus 100 provides timing and control signals to the respective components to provide control of the various components and process control parameters of the apparatus in accordance with well understood and known employments. A cleaning station 101*a* for transport web 101 is also typically provided to allow continued reuse thereof.

Figure 3:
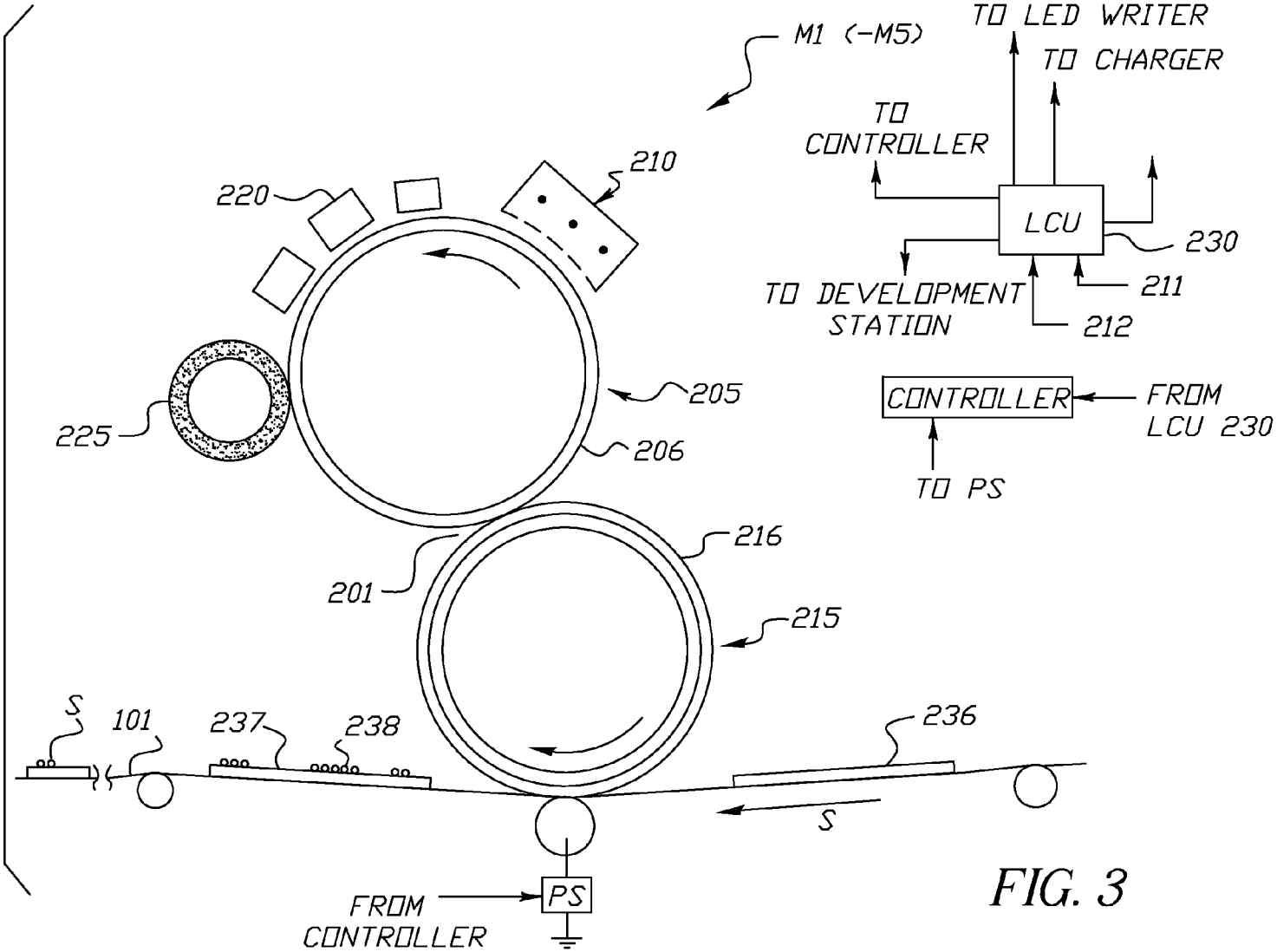
FIG. 3 is a schematic side elevational view, in cross section, of one printing module of the electrophotographic reproduction apparatus of FIG. 1, on an enlarged scale.
Figure 4A:
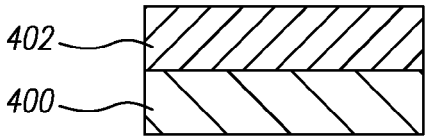
FIG. 4 is a schematic diagram displaying 1) a non-raised area without a protective overcoat layer, 2) a non-raised area with a protective overcoat layer, 3) a raised image area, and 4) a raised rich black image area.
Figure 4B:
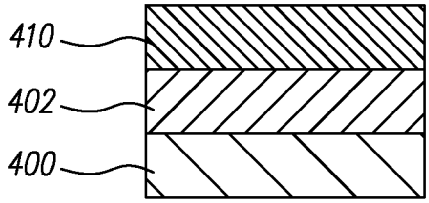
Figure 4C:
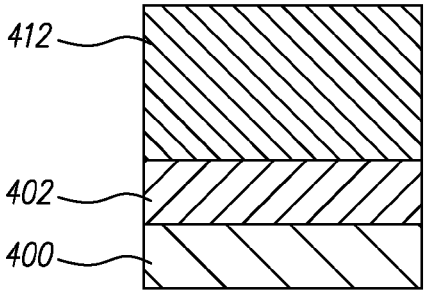
Figure 4D:
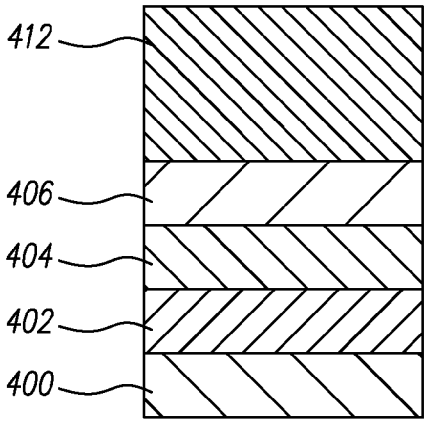

With reference to FIG. 3 wherein a representative printing module (e.g., M1 of M1-M5) is shown, each printing module of the electrophotographic printer apparatus 100 includes a plurality of electrophotographic imaging subsystems for producing one or more multilayered image or shape. Included in each printing module is a primary charging subsystem 210 for uniformly electrostatically charging a surface 206 of a photoconductive imaging member (shown in the form of an imaging cylinder 205). An exposure subsystem 220 is provided for image-wise modulating the uniform electrostatic charge by exposing the photoconductive imaging member to form a latent electrostatic multi-layer (separation) image of the respective layers. A development station subsystem 225 serves for developing the image-wise exposed photoconductive imaging member. An intermediate transfer member 215 is provided for transferring the respective layer (separation) image from the photoconductive imaging member through a transfer nip 201 to the surface 216 of the intermediate transfer member 215 and from the intermediate transfer member 215 to a receiver member (receiver member 236 shown prior to entry into the transfer nip and receiver member 237 shown subsequent to transfer of the multilayer (separation) image) which receives the respective (separation) images 238 in superposition to form a composite image thereon.

Subsequent to transfer of the respective (separation) multilayered images, overlaid in registration, one from each of the respective printing modules M1-M5, the receiver member is advanced to a fusing assembly across a space 109 to optionally fuse the multilayer toner image to the receiver member resulting in a receiver product, also referred to as a print. In the space 109 there may be a sensor 104 and an energy source 110. This can be used in conjunction to a registration reference 312 as well as other references that are used during deposition of each layer of toner, which is laid down relative to one or more registration references, such as a registration pattern.

The apparatus of the invention can use a clear (non-pigmented) or other specialized toner in one or more stations. The specialized toner differs from the pigmented toner described above in such that it has some unique property, such as larger particle size or different melt viscosity from that described above.

In some circumstances the printer is used to lay down a higher amount of toner. The application of a higher mass laydown of toner, say to produce a raised image effect in one embodiment, can be achieved with a mass laydown of 2.0 $mg/cm^2$ or greater, on top of specific regions of color images. This higher mass laydown of toner to produce a raised image effect is defined as 100% coverage for this specific toner. The total mass laydown (TML) of a raised image area is defined as the maximum toner mass laydown possible yielding the maximum raised effect. For a pentachrome system the TML is obtained by summing the maximum laydown of the 5 toning stations consisting of the 100% coverage of the toner used to produce the raised image and the maximum laydowns delivered by the other 4 toner delivery systems.

For a pentachrome system consisting of cyan, magenta, yellow, black (CMYK), and clear (non-pigmented) toners, the TML is defined as the 100% coverage of the clear toner placed on top of a rich black (maximum density) area. Using a mass density of 1.1 g/cc for fused toner, a mass laydown of 2.0 $mg/cm^2$ for the clear toner will provide an 18 μm raised image effect. Placed on top of a rich black area consisting of 1.2 $mg/cm^2$ of CMYK will result in a total mass laydown (TML) of 3.2 $mg/cm^2$ and a total raised image effect of 29 μm. The addition of the clear toner in these regions increases the total mass per unit area of toner that needs to be melted to levels significantly greater than 2.0 $mg/cm^2$, frequently exceeding 3.0 $mg/cm^2$ for highly saturated image areas.

However, within the same print there will be non-raised image areas with substantially less than 2.0 $mg/cm^2$ of toner mass laydown, herein referred to as the non-raised mass laydown (NRML). The required fuser settings for good toner adhesion of the high toner mass laydown, raised image regions results in substantial hot offset artifacts for the lower toner mass laydown, non-raised image regions. In some embodiments the non-raised mass laydown (NRML) is a function of one or more of the color mass laydown (CML) of cyan, magenta, yellow, black (CMYK), as well as the TML is defined as the 100% coverage of the clear toner placed on top of a rich black (maximum density) image area.

It has been found that the deposition of a significantly less than 100% coverage of clear toner in the non-raised image areas, defined as the clear overcoat mass laydown (OML) and significantly less than 2.0 $mg/cm^2$, can serve as a protective overcoat layer, pushing the hot offset failure to a higher temperature, thereby enhancing the fuser offset latitude and enabling the use of a high mass laydown of toner for a raised print application in all circumstances, for example when one or more receivers are of a dense or coated paper, which does not readily absorb oil. Essentially, the total toner mass laydown of the non-raised regions (the sum of the NRML and OML) is increased so as to avoid excessive heating and cohesive failure. This invention also reduces the maintenance requirements of the fusing subsystem with the elimination of the hot offset. Preferably, this coverage is in the range of 0% to 60%, the exact coverage depending upon the mass laydown of the non-clear toner (NRML) as well as other factors describing the fuser subsystem, the toner materials, and the receiver member. Note that in general the mass laydown per area of the protective overcoat layer (OML) is non-linear with % coverage, such that 50% coverage will be noticeably less than ½ of the mass laydown associated with 100% coverage. Another benefit of this protective layer is the reduction of the color shift observed between raised and non-raised image areas. The low coverage of clear toner in the non-raised image areas is still sufficient to reduce the toner flow in fusing, thereby resulting in more similar color shifts as observed in the raised image areas, the color shift being measured relative to a CMYK toner laydown without any protective layer.

Associated with the printing modules M1 (-M5) is a main printer apparatus logic and control unit (LCU) 230, which receives input signals from the various sensors associated with the printer apparatus and sends control signals to the chargers 210, the exposure subsystem 220 (e.g., LED writers), and the development stations 225 of the printing modules M1-M5. Each printing module may also have its own respective controller coupled to the printer apparatus main LCU 230.

Subsequent to the transfer of the multiple layer toner (separation) images in superposed relationship to each receiver member, the receiver member is then serially de-tacked from transport web 101 and sent in a direction to the fusing assembly 60 to fuse or fix the dry toner images to the receiver member. This is represented by the five modules shown in FIG. 2 but could include only one module and preferably anywhere from two to as many as needed to achieve the desired results. The transport web is then reconditioned for reuse by cleaning and providing charge to both surfaces 124, 125 (see FIG. 2) which neutralizes charge on the opposed surfaces of the transport web 101.

The electrostatic image is developed by application of marking particles (toner) to the latent image bearing photoconductive drum by the respective development station 225. Each of the development stations of the respective printing modules M1-M5 is electrically biased by a suitable respective voltage to develop the respective latent image, which voltage may be supplied by a power supply or by individual power supplies (not illustrated). Preferably, the respective developer is a two-component developer that includes toner marking particles and carrier particles, which could be magnetic. Each development station has a particular layer of toner marking particles associated respectively therewith for that layer. Thus, each of the five modules creates a different layer of the image on the respective photoconductive drum. As will be discussed further below, a pigmented (i.e., color) toner development station may be substituted for one or more of the non-pigmented (i.e., clear) developer stations so as to operate in similar manner to that of the other printing modules, which deposit pigmented toner. The development station of the clear toner printing module has toner particles associated respectively therewith that are similar to the color marking particles of the development stations but without the pigmented material incorporated within the toner binder.

With further reference to FIG. 1, transport belt 101 transports the toner image carrying receiver members to an optional fusing or fixing assembly 60, which fixes the toner particles to the respective receiver members by the application of heat and pressure. More particularly, fusing assembly 60 includes a heated fusing roller 62 and an opposing pressure roller 64 that form a fusing nip therebetween. Fusing assembly 60 also includes a release fluid application substation generally designated 68 that applies release fluid, such as, for example, silicone oil, to fusing roller 62. The receiver members or prints carrying the fused image are transported seriatim from the fusing assembly 60 along a path to either a remote output tray, or is returned to the image forming apparatus to create an image on the backside of the receiver member (to form a duplex print).

In one embodiment, the electrostatographic printing apparatus 100 shown in FIG. 3 prints images that have multiple layers deposited upon the receiver. The electrostatographic printing apparatus includes an imaging member 205 and a development station 225 for depositing two or more layers of toner using a combination or color and specialized toner by the method shown in FIG. 4. The specialized toner could be clear but could also include pearlized, metal and/or other such specialized toner, all hereafter referred to as clear toner, having an OML mass laydown, for simplicity. The multilayer clear and pigmented toner, can be obtained by a number of ways including multiple station laydowns, multiple stations and passes through those stations in registration to each other and/or replacing one or more pigmented station with a clear station, such as replacing the K station. The method of optimized printing can be variable, such as sheet to sheet or within one sheet as well area dependent.

Shown in FIG. 4 are examples of cross-sections of raised and non-raised image areas, demonstrating the additional height provided by the clear overcoat layer for a raised image effect, and the additional protection provided by the clear overcoat layer of this invention. FIG. 4*a* shows a non-raised image area without the protection of a clear overcoat layer, consisting of toner layers 400 and 402. FIG. 4*b* shows the same toner layers as in FIG. 4*a* with the addition of a clear toner layer 410 at less than 100% coverage, providing protection against the hot offset limitation. The level of clear overcoat mass laydown (OML) for this non-raised mass laydown (NRML) has been determined experimentally and will be described below. FIG. 4*c* shows the same toner layers as FIG. 4*a* with the addition of a clear toner layer 412 at 100% coverage so as to provide the raised image effect. FIG. 4*d* shows the raised image effect on a rich black area consisting of 4 color toner layers, 400, 402 404, 406, and clear toner layer 412 at 100% coverage. The toner mass laydown in FIG. 4*d* represents the maximum laydown that needs to be fused and therefore defines the TML of the system.

Figure 5:
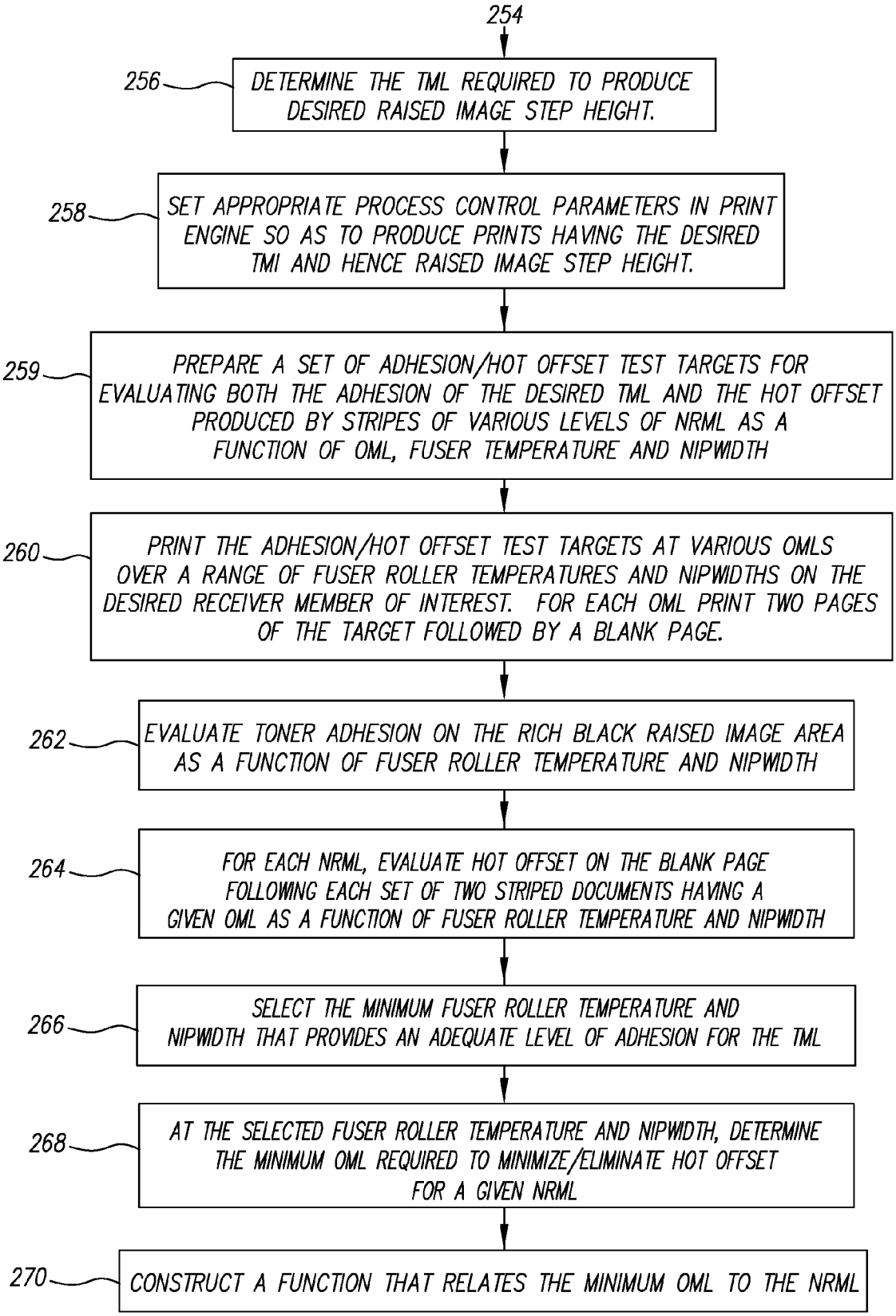
FIG. 5 is a flowchart outlining a procedure for determining the level of protective clear overcoat required.
Figure 6:
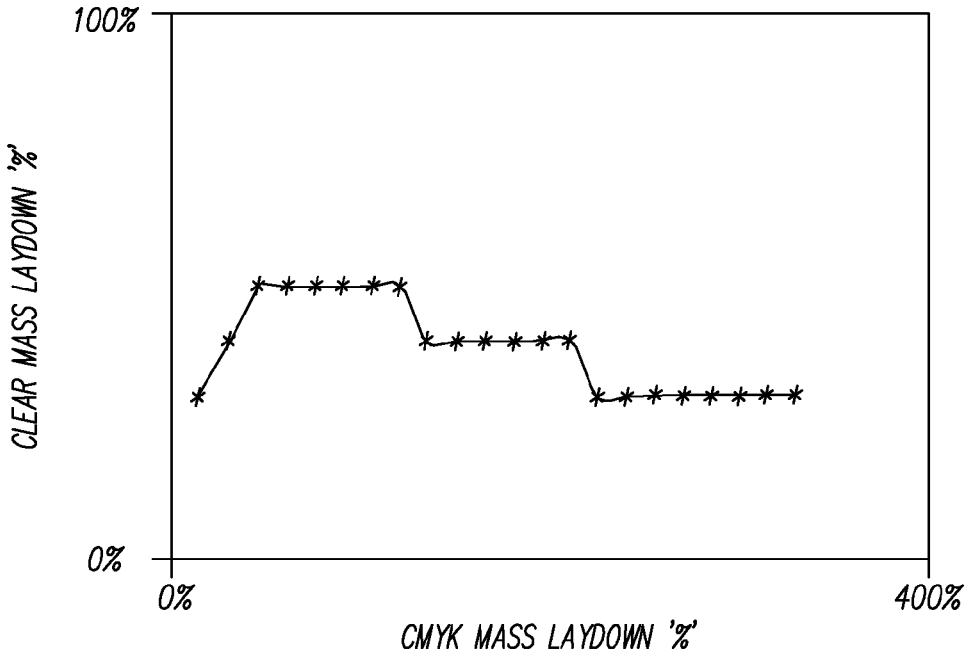
FIG. 6 is a graph displaying the laydown dependence of the protective clear layer on the total CMYK laydown.

A method 254 for determining the amount of OML required as a function of the NRML and a given receiver member for protecting the non-raised image areas is now described and shown in the flowchart provided in FIG. 5. In the first step 256 the TML is determined so as to provide the desired raised image step height. As a second step 258 the appropriate process control parameters in a print engine are set so as to produce prints having the desired TML and hence, raised image step height. In step three 259 a set of adhesion/hot offset test targets is prepared for evaluation of both the adhesion of the desired TML and the hot offset produced by stripes of various levels of NRML as a function of OML, fuser temperature and nipwidth. This set of adhesion/hot offset test targets consists of: 1) solid areas of a raised rich black for evaluation of adhesion to the receiver member and 2) a set of color stripes extending in the printer machine direction, each stripe uniform in NRML but having a different NRML from each other stripe so that the set of stripes cover the range of possible NRMLs from low to high, without any OML applied to this set of stripes. The length of the color stripes must be sufficient so as to allow for the possibility of creating hot offset contamination on rollers in the fuser subsystem and then offsetting that contamination from the rollers onto the sheet or a subsequent blank sheet, creating a ghost image. Further, several versions of this image file are created, each version having a different level of OML placed on top of the set of color stripes having varying NRML. In step four 260 prints are generated over a range of fuser temperature and nip width settings using the various image files. In step five 262 observations are made of the level of adhesion in the raised rich black areas as a function of fuser roller temperature and nipwidth. In step six 264 observations are made on the level of hot offset for a given color stripe NRML as a function of the OML and fuser roller temperature and nipwidth. In step seven 266 select the minimum fuser roller temperature and nipwidth that provide an adequate level of adhesion for the TML. In step eight 268, at the selected fuser roller temperature and nipwidth, determine the minimum OML required to minimize/eliminate hot offset for a given NRML. In step nine 270 construct a function that relates the minimum OML required to prevent hot offset for a given NRML using the temperature and nip width that provides good adhesion for the TML region, as shown in FIG. 6.

In one embodiment the method of optimizing formation of a raised multicolor image on a receiver member includes forming a multicolor toner image having raised areas with 100 percent coverage of a clear overcoat toner on a receiver member having non-raised areas and an multicolor toner image with one or more layers of color toner, each color toner in a non-raised area having a non-raised mass laydown (NRML; mg/cm2); determining an amount of clear overcoat mass laydown in the non-raised areas (OML; mg/cm2), as a function of one or more NRML based factors comprising a fuser temperature and a nipwidth to optimize the fuser latitude while not exceeding a total mass laydown (TML); and fusing the clear toner overcoat and the multicolor toner image at a fusing temperature determined by the maximum total mass laydown (TML) in a raised area and the nip width to provide good adhesion to the receiver member while optimizing fuser offset latitude. This is useful in circumstances that could include a combination of raised print on difficult to fuse receivers, such receivers include one or more of a dense or coated paper that does not readily absorb oil.

Optimized fuser latitude is determined by final fused print feedback wherein the final fused print feedback comprises one or more sensors. The sensors can measure one or more density readings, one or more pixel readings and/or the maximum height can be determined in conjunction to the final fused print feedback and/or stored information including a lookup table.

Figure 7:
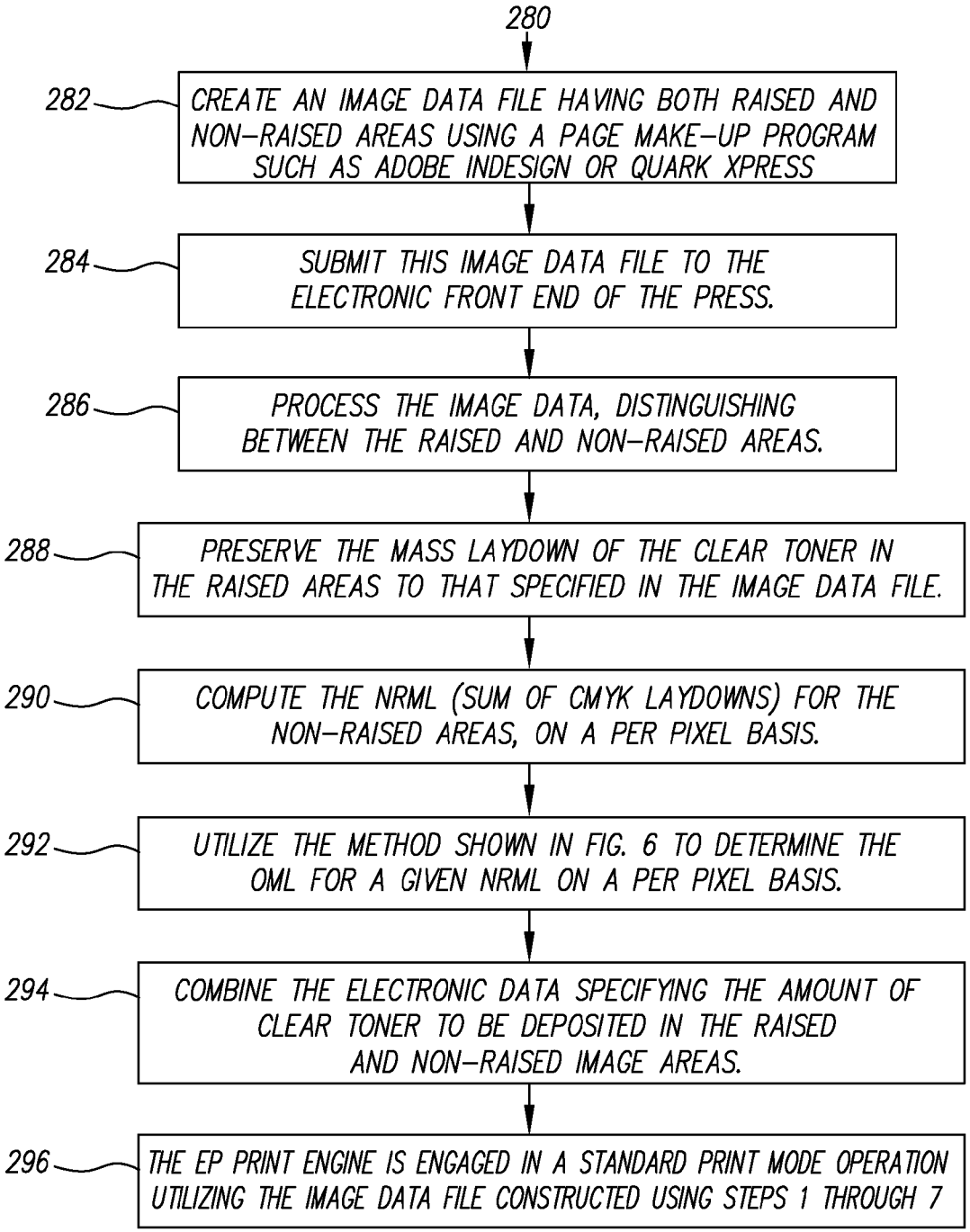
FIG. 7 is an embodiment of a method for printing an image having both raised and non-raised areas.

In a particular embodiment shown in FIG. 7 the method 280 for electrophotographic printing of raised images upon a receiver member includes a first step 282 to create an image data file having both raised and non-raised areas using a page make-up program such as Adobe InDesign™ or Quark Xpress™. The image data file having both a raised image data portion for one or more raised areas and non-raised image data portions for one or more non-raised areas. In a next step 284 this image data file is submitted to the electronic front end of the press. In a third step 286 the image data is processed, distinguishing between the raised and non-raised areas. In a fourth step 288 the mass laydown of the clear toner in the raised areas is preserved to that specified in the image data file. In a fifth step 290 a computation is performed of the NRML (sum of CMYK laydowns) for the non-raised areas, on a per pixel basis. In a sixth step 292 the method shown in FIG. 6 is utilized to determine the OML for a given NRML on a per pixel basis. In a seventh step 294 the electronic data specifying the amount of clear toner to be deposited in the raised and non-raised image areas is combined so that both a raised image data portion and the non-raised image data portions to create a final image data file. In an eighth step 296 the EP print engine is engaged in a standard print mode of operation using the image data file as constructed in steps 1 through 7 including depositing toner.

This method can be used to laydown clear toner directly on a receiver or directly on top of colored or other clear toner and/or any combination of these by forming a first multicolor toner image having raised areas with 100 percent coverage of a clear overcoat toner on the receiver member; forming a second multicolor toner image having non-raised areas with one or more layers of color toner, the non-raised area having a non-raised mass laydown (NRML; mg/cm2); and combining the first and the second multicolor toner images having raised areas and non-raised areas and depositing toner accordingly.

The logic and control unit (LCU) 230 shown in FIG. 3 includes a microprocessor incorporating suitable look-up tables and control software, which is executable by the LCU 230. The control software is preferably stored in memory associated with the LCU 230. Sensors associated with the fusing assembly provide appropriate signals to the LCU 230. In response to the sensors, the LCU 230 issues command and control signals that adjust the heat and/or pressure within fusing nip 66 and otherwise generally nominalizes and/or optimizes the operating parameters of fusing assembly 60 for imaging substrates.

Image data for writing by the printer apparatus 100 may be processed by a raster image processor (RIP), which may include either a layer or a color separation screen generator or generators. For both a clear and a colored layered image case, the output of the RIP may be stored in frame or line buffers for transmission of the separation print data to each of respective LED writers, for example, K, Y, M, C, and L (which stand for black, yellow, magenta, cyan, and clear respectively, or alternately multiple clear layers $L_1$, $L_2$, $L_3$, $L_4$, and $L_5$. The RIP and/or separation screen generator may be a part of the printer apparatus or remote therefrom. Image data processed by the RIP may be obtained from a multilayer document scanner such as a color scanner, or a digital camera or generated by a computer or from a memory or network which typically includes image data representing a continuous image that needs to be reprocessed into halftone image data in order to be adequately represented by the printer. The RIP may perform image processing processes including layer corrections, etc. in order to obtain the desired final shape on the final print. Image data is separated into the respective layers, similarly to separate colors, and converted by the RIP to halftone dot image data in the respective color using matrices, which include desired screen angles and screen rulings. The RIP may be a suitably programmed computer and/or logic devices and is adapted to employ stored or generated matrices and templates for processing separated image data into rendered image data in the form of halftone information suitable for printing.

The amount of clear toner to be used as a protective layer (OML), sometimes referred to as an overcoat layer, will be a function of CMYK toner laydown (NRML), receiver member surface type (e.g. coated or uncoated), surface roughness (e.g. textured or smooth), and basis weight, as well as fuser operational set points such as fuser roller temperature and nip-width, having been selected so as to produce good adhesion for the TML that provides the desired raised step height. The amount of OML required as a function of the NRML can be determined during a substrate qualification step, which will map both fusing quality and hot offset responses as a function of both fusing set points and the amount of OML added to ranges of NRML, as outlined in FIG. 5. Once set points providing good fusing quality are determined, the OML required for a given NRML can be determined to prevent hot offset. An example of the required raised clear laydown needed to be added to prevent hot offset on two textured and two uncoated papers for a 3.5 mg/cm$^2$ TML is shown in FIG. 6. This can be implemented in several ways such as through the use of an ICC profile unique for a given substrate, or through the use of a look-up table or a polynomial, which will apply an OML as a function of the NRML. For the raised areas of an image data file calling for 100% clear on top of the CMYK laydown to provide a raised effect, this will over-ride the OML called for in the ICC profile or algorithm.

The various set-points to be used when optimizing the printing of raised print include development potential and other transfer process set-points. Examples of electrophotographic processes set-point (operating algorithms) values that may be controlled in the electrophotographic printer to alternate predetermined values when printing raised images include, for example: fusing temperature, fusing nip width, fusing nip pressure, imaging voltage on the photoconductive member, toner particle development voltage, transfer voltage and transfer current. In an electrophotographic apparatus that makes prints with raised images, a special mode of operation may be provided where the predetermined set points (implemented as control parameters or algorithms) are used when printing the raised images. That is, when the electrophotographic printing apparatus prints non-raised images, a first set of set-points/control parameters are utilized. Then, when the electrophotographic printing apparatus changes mode to print raised images, a second set of set-points/control parameters are utilized. Set points for use with particular toner or toners can be determined heuristically.

Some of the optimizing factors include a particular size distribution of marking particles. Additional factors may include surface treatment level and material, surface treatment process conditions, permanence, clarity, color, form, surface roughness, smoothness, color clarity and refractive index. Additionally others may include one or more of the following: toner viscosity, color, density, surface tension, melting point and finishing methods including the use of fusing and pressure rollers.

The toner used to form the images can be styrenic (styrene butyl acrylate) type used in toner with a polyester toner binder. In that use typically the refractive index of the polymers used as toner resins have a refractive index of 1.53 to almost 1.60. These are typical refractive index measurements of the polyester toner binder, as well as styrenic (styrene butyl acrylate) toner. Typically the polyesters are around 1.54 and the styrenic resins are 1.59. The conditions under which it was measured (by methods known to those skilled in the art) are at room temperature and about 590 nm. One skilled in the art would understand that other similar materials could also be used.

The optimizing factors can be determined experimentally in the laboratory, as described here, or can be developed over time during usage. Furthermore, a library of such optimizing parameters may be built up over time for use whenever an operator wishes to print a raised image, as discussed above.

U.S. Pat. No. 6,421,522, assigned to Eastman Kodak, describes one method and apparatus for setting registration in a multi-color machine having a number of exposure devices so that accurate registration patterns and thus toner location is achieved as necessary in the current application. This patent specifically addresses the effects of toner profile on registration and is incorporated by reference. Additional necessary components provided for control may be assembled about the various process elements of the respective printing modules (e.g., a meter for measuring the uniform electrostatic charge, a meter for measuring the post-exposure surface potential within a patch area of a patch latent image formed from time to time in a non-image area on surface, etc). Further details regarding the electrophotographic printer apparatus 100 are provided in U.S. Patent Publication No. 2006/0133870, published on Jun. 22, 2006, in the name of Yee S. Ng et al.

In another embodiment, for low fusing latitude receiver members, there are several ways in which additional modules, such as a fourth or fifth image data module, can be used to increase the fuser latitude when using low fusing latitude receiver members. A low fusing latitude receiver member may be a dense or coated paper that does not readily absorb the oil often used as a release agent in roller fusing systems. Examples of such receiver member types include Esse Pearlized™ paper from Gilbert or Beargrass™ Digital paper from Aspire Petallics. The fuser temperature and nipwidth that provides good adhesion in a NexPress 2500 press results in significant hot offset problems and therefore little or no operational fuser latitude.

It was found that by using a clear (non-pigmented) toner and depositing a clear overcoat mass laydown (OML) only upon the color toner image, having a color mass laydown (CML), using a function such as that shown in FIG. 6, a region of fusing temperature and nipwidth was discovered where no hot offset occurred. It should be noted that no clear toner was deposited in the non-image areas. The clear toner used in this case had a mean diameter by volume of 8 μm and the 100% coverage was defined as 0.45 mg/cm$^2$. An alternative function that may be used to generate the fifth module image data by the digital front end (DFE) from original CMYK color data is the inverse mask technique of U.S. Pat. No. 7,139,521, issued Nov. 21, 2006, in the name of Yee S. Ng et al and pending application Ser. No. 11/155,268 entitled "Method and Apparatus For Electrostatographic Printing With Generic Color Profiles And Inverse Masks Based On Receiver Member Characteristics". The inverse mask for printing is formed such that any rendered CMYK color pixel value with greater than 10% coverage. This coverage, referred to as a base percent coverage, is therefore greater than 10% coverage and will have added to it a 90% coverage as a fifth module pixel value. Accordingly, the desired final image can be printed on the low fusing latitude receiver member with good adhesion while optimizing fuser offset latitude.

The function in one embodiment can be directly proportional to the sum of one or more color mass laydowns to optimize fuser offset latitude and/or to control color shift before forming the clear toner overcoat before fusing the clear toner overcoat and the multicolor toner image at a fusing temperature determined by one or more of one color mass laydown, the clear mass laydown and a nip width such that the clear mass laydown is controlled by the function of the sum. wherein the function is one of an inverse mask or proportional to the clear mass laydown in non-raised areas. The optimized fuser latitude is determined by final fused print feedback, which may include one or more sensors and/or one or more tables of predetermined setpoints.

The invention has been described in detail with particular reference to certain preferred embodiments thereof, but it will be understood that variations and modifications can be effected within the spirit and scope of the invention. This invention is inclusive of combinations of the embodiments described herein. References to a "particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular and/or plural in referring to the "method" or "methods" and the like are not limiting.

The invention claimed is:

1. A method of enhancing fuser offset latitude during electrophotographic printing of a raised multicolor image on a receiver member, the method comprising:

forming a first multicolor toner image having raised areas with 100 percent coverage of a clear overcoat toner on the receiver member;

forming a second multicolor toner image having non-raised areas with one or more layers of color toner, the non-raised area having a non-raised mass laydown (NRML; mg/cm2);

determining an amount of clear overcoat mass laydown in the non-raised areas (OML; mg/cm2), as a function of one or more NRML based factors comprising a fuser temperature and a nipwidth to optimize the fuser latitude while not exceeding a total mass laydown (TML);

combining the first and the second multicolor toner images having raised areas and non-raised areas and depositing toner accordingly;

fusing the clear toner overcoat and the multicolor toner image at a fusing temperature determined by the maximum total mass laydown (TML) in a raised area and the nip width to provide good adhesion to the receiver member while optimizing fuser offset latitude.

2. The method of claim 1 wherein said various combinations of colors at different pixel locations on the receiver member form the multicolor raised image using a generic color profile based on receiver member characteristics.

3. The method of claim 1 wherein the color mass laydown is directly related to unfused toner height.

4. The method of claim 1 wherein the total mass laydown (TML) is defined as 100% coverage of the clear toner placed on top of rich black image area.

5. The method of claim 1 wherein said optimized fuser latitude is determined by final fused print feedback.

6. The method of claim 5 wherein said final fused print feedback comprises one or more sensors.

7. The method of claim 6 wherein said one or more sensors measure one or more density reading.

8. The method of claim 6 wherein said one or more sensors measure one or more pixel reading.

9. The method of claim 1 wherein said forming step further comprising forming a multicolor toner image having raised areas with 100 percent coverage of a clear overcoat toner on top of areas with one or more layers of color toner.

10. A method of enhancing fuser offset latitude during electrophotographic printing of a raised multicolor image on a receiver member, the method comprising:

forming a multicolor toner image on the receiver member with toners of at least three different colors of toner pigments, each having a color mass laydown;

determining a function directly proportional to the sum of one or more color mass laydowns to optimize fuser offset latitude;

forming a clear toner overcoat having a clear mass laydown upon the multicolor toner image wherein the clear mass laydown is controlled by the function of the sum; and fusing the clear toner overcoat and the multicolor toner image at a fusing temperature determined by one or more of one color mass laydown, the clear mass laydown and a nip width to provide good adhesion to the receiver member while optimizing fuser offset latitude.

11. The method of claim 10 wherein said various combinations of colors at different pixel locations on the receiver member form the multicolor raised image using a generic color profile based on receiver member characteristics.

12. The method of claim 10 wherein said function is an inverse mask.

13. The method of claim 10 wherein said set base percent is 10%.

14. The method of claim 10 wherein said optimized fuser latitude is determined by final fused print feedback.

15. The method of claim 14 wherein said final fused print feedback comprises one or more sensors.

16. The method of claim 15 wherein said one or more sensors measure one or more pixel reading.

17. The method of claim 15 wherein said one or more receivers comprise one or more of a dense or coated paper that does not readily absorb oil.

18. A method of enhancing fuser offset latitude during electrophotographic printing of a raised multicolor image on a receiver member, the method comprising:

forming a multicolor toner image on the receiver member with toners of at least three different colors of toner pigments, each having a color mass laydown;

determining a function directly proportional to the sum of one or more color mass laydowns to control color shift;

forming a clear toner overcoat having a clear mass laydown upon the multicolor toner image wherein the clear mass laydown is controlled by the function of the sum; and fusing the clear toner overcoat and the multicolor toner image at a fusing temperature determined by one or more of one color mass laydown, the clear mass laydown and a nip width to minimize color shifting all areas of said multicolor toner image.

19. The method of claim 18 wherein said various combinations of colors at different pixel locations on the receiver member form the multicolor raised image using a generic color profile based on receiver member characteristics.

20. The method of claim 18 wherein said function is an inverse mask.

21. The method of claim 18 wherein said optimized fuser latitude is determined by final fused print feedback.

22. The method of claim 21 wherein said final fused print feedback comprises one or more sensors.

* * * * *